US005953805A

United States Patent [19]

Steingroever

[11] Patent Number: 5,953,805

[45] Date of Patent: Sep. 21, 1999

[54] MAGNET FIELD CONCENTRATOR FOR SHAPING METAL PARTS

[75] Inventor: Erich Steingroever, Bonn, Germany

[73] Assignee: Magnet-Physik Dr. Steingroever GmbH, Germany

[21] Appl. No.: 08/904,272

[22] Filed: Jul. 31, 1997

[30] Foreign Application Priority Data

Aug. 8, 1996 [DE] Germany ..... 196 32 001
Dec. 20, 1996 [DE] Germany ..... 296 22 176 U

[51] Int. Cl.[6] ..... B21D 26/02

[52] U.S. Cl. ..... 29/419.2; 72/56; 72/54; 29/517

[58] Field of Search ..... 29/753, 862, 863, 29/517, 520, 419.2; 72/56, 54

[56] References Cited

U.S. PATENT DOCUMENTS

| | | | |
|---|---|---|---|
| 3,252,313 | 5/1966 | Eilers et al. | 72/56 |
| 3,391,558 | 7/1968 | Deeg | 72/56 |
| 3,412,590 | 11/1968 | Lippmann et al. | 72/56 |
| 3,486,356 | 12/1969 | Brower et al. | 72/56 |
| 3,543,550 | 12/1970 | Rose | 72/56 |
| 3,602,023 | 8/1971 | Furth | 72/56 |
| 3,654,787 | 4/1972 | Brower | 72/56 |
| 3,832,509 | 8/1974 | Mikhailov et al. | 219/672 |
| 3,842,630 | 10/1974 | Mikhailov et al. | 72/56 |
| 3,896,647 | 7/1975 | Mikhailov et al. | 72/56 |
| 4,143,532 | 3/1979 | Khimenko et al. | 72/56 |
| 4,170,887 | 10/1979 | Baranov | 72/56 |
| 4,522,790 | 6/1985 | Dantzig et al. | 422/246 |
| 5,586,460 | 12/1996 | Steingroever | 72/56 |

FOREIGN PATENT DOCUMENTS

| | | | |
|---|---|---|---|
| 0577067 | 10/1977 | U.S.S.R. | 72/56 |

*Primary Examiner*—David P. Bryant
*Assistant Examiner*—John Preta
*Attorney, Agent, or Firm*—Harold Gell

[57] ABSTRACT

A magnetic field concentrator for shaping metal parts by way of a high magnet impulse, with an opening in the form of a radially split mold, partially formed by a sabot/magnetic field shaping piece, to receive the part to be shaped, wherein the part to be shaped may have terminal end fittings or similar parts with a larger outside dimension than the work receiving opening.

20 Claims, 5 Drawing Sheets

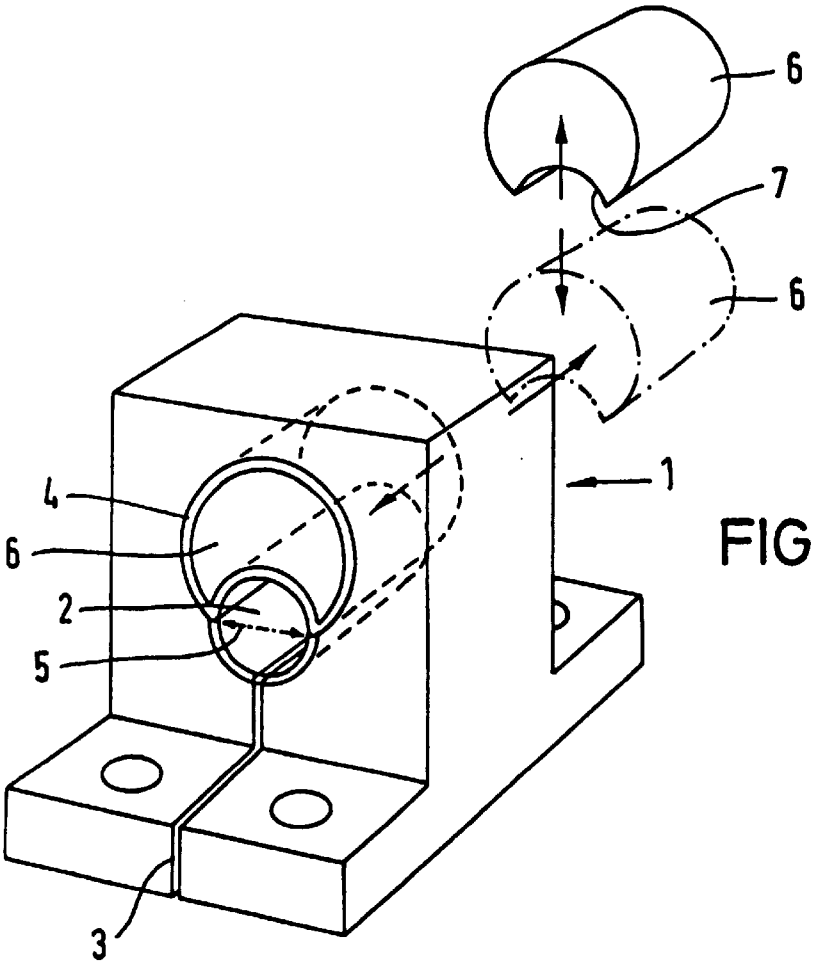
FIG.1
FIG.2
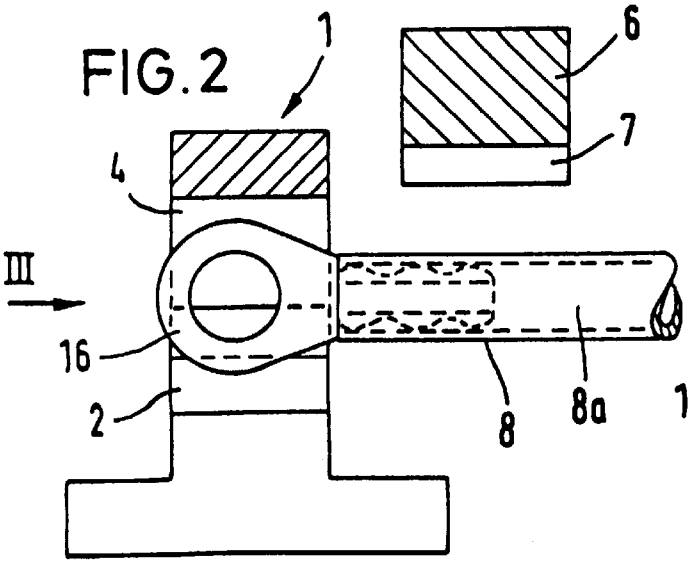
FIG.3
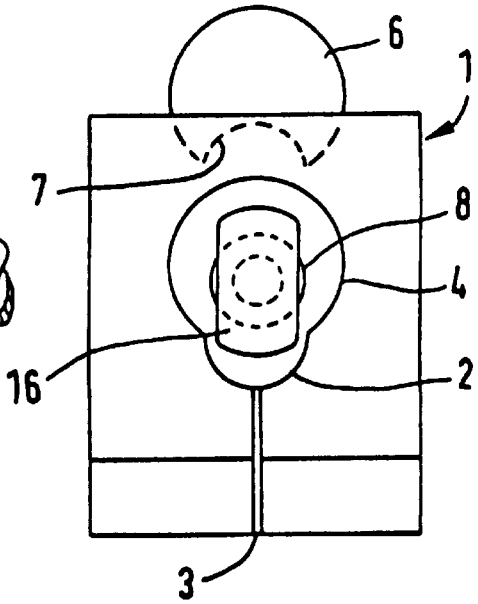

MAGNET FIELD CONCENTRATOR FOR SHAPING METAL PARTS

FIELD OF THE INVENTION

The invention relates to a high current loop employed as a magnetic field concentrator for shaping metal parts through the use of a strong magnetic impulse with a forming opening to receive the part to be shaped and a slit radiating from this opening and a process for shaping metal parts with the magnetic field concentrator.

BACKGROUND OF THE INVENTION

Fastening end terminal fittings to tubular metal parts with a larger outside dimension than the tubular part itself, such as conduits with terminal end connection parts, require a segmented magnetic field concentrator designed to have at least two pieces and include an opening dimensioned for receiving the part to be shaped there between. Such magnetic field concentrators clamp and hold the component either through a clamp joined with a side joint or hinge or a collapsible encloser for clamping the shaping parts, or through radial pressure from outside on the clamp backs, forcefully holding them together.

The foregoing places high mechanical demands on the components of the magnetic field concentrator. In addition, considerable difficulties are encountered in obtaining a flawless current passage between the compressed parts of the magnetic field concentrator.

OBJECTIVES OF THE INVENTION

The task of the invention is to provide a magnetic field concentrator for shaping metal parts by a strong magnet impulse, with an opening in the form of a radially split mold to receive the part to be shaped, wherein the part to be shaped may include terminal end fittings or similar parts with a larger outside dimension than the work receiving opening in the magnetic field concentrator. This is to be accomplished without difficulties in opening the magnetic field concentrator to insert or remove the part. Further more, the current flow through the magnetic field concentrator should not be influenced detrimentally or interrupted.

SUMMARY OF THE INVENTION

The above task finds its solution in a high current loop operating as a magnetic field concentrator which, according to the invention, includes a first opening which has a clear diameter at a common plane shared by a second opening with a larger diameter than the first opening, so that the outline of the larger opening sets at this intersection, and the larger opening accommodates a removable sabot/magnetic field shaping piece fabricated from a metal with a high electric conductivity which acts as a flux conductor.

Especially advantageous embodiments of the invention are contained in claims 1 through 30 and claims 31 and 32 provide methods for shrinking tubes on fittings when the largest diameter of the fitting exceeds the diameter of the tube.

The invention has the advantage in that the magnetic field concentrator includes the smaller, first opening with an axis parallel to but displaced from the larger opening and the edge of the radial slit to the openings, and the sabot/magnetic field shaping piece fitting into the larger, second opening is manufactured from a solid metal block so that unlike the prior art, the current flow is not impeded by the several securing components and joint combinations around a metal part to be shaped which are required for creating the part accepting opening in the magnetic field concentrator of the prior art. This is particularly advantageous if the part to be shaped is a pipe or tube section with a terminal end fitting that has a larger diameter or greater outside dimensions than the opening for shaping the metal part by the magnetic field concentrator. It is obvious that the invention is also advantageous if a fitting is to be fastened to previously magnetically formed multiple curved tubing or similar components.

Moreover, the idea of using only axial movement in removing the sabot/magnetic field shaping piece in the larger opening of the magnetic field concentrator enables removing the shaped metal part from the magnetic field concentrator with simple mechanical arrangements to rotate or turn it, if necessary, prior to vertically lifting.

A further advantage is the electrical insulations between the magnetic field concentrator, the sabot/magnetic field shaping piece and the metal part to be shaped can be accomplished simply by insulating sheets, lacquer coatings or other applicable insulating measures.

BRIEF DESCRIPTION OF THE DRAWINGS

A preferred embodiment of the invention is presented schematically in the drawings where:

FIG. 1 is a perspective view illustrating the parallel axes of a magnetic field concentrator, a part to be shaped opening and a sabot/magnetic field shaping piece which is exploded from the larger receiving opening, FIG. 2 is a vertical longitudinal section through the magnetic field concentrator with the sabot/magnetic field shaping piece removed from the larger opening showing the installation of a tube with a fitting, to be fastened to it for shaping, with a larger diameter or larger measurements than the opening to the magnetic field concentrator, FIG. 3 is a front view of the magnetic field concentrator taken in the direction of the arrow III of FIG. 2.

DETAILED DESCRIPTION OF THE PREFERRED EMBODIMENTS

Figure 4:
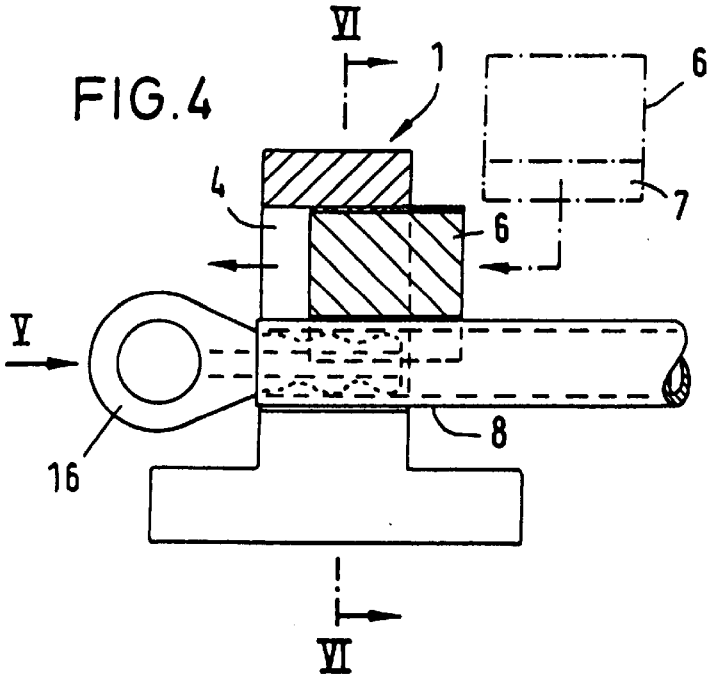
FIG. 4 is a longitudinal section through the magnetic field concentrator after insertion of the part to be shaped in the first opening and the partial insertion of the sabot/magnetic field shaping piece in the larger opening of the magnetic field concentrator.
Figure 5:
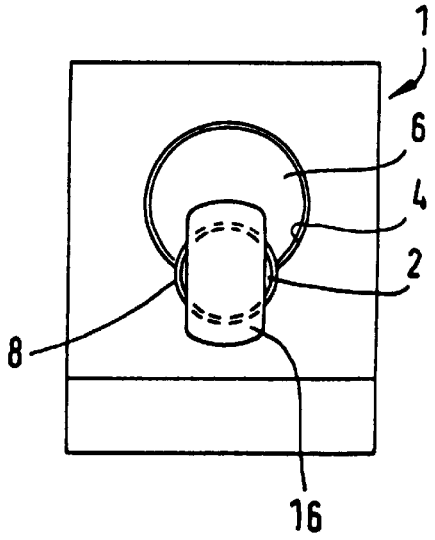
FIG. 5 is a front view of the magnetic field concentrator taken in the direction of the arrow V of FIG. 4.

FIGS. 1 and 2 shows a magnetic field concentrator 1 for the shaping of metal parts through a strong magnet impulse. The magnetic field concentrator 1 has an opening 2 to receive a part 8 to be shaped and a radial slit 3 from the opening 2.

FIGS. 1 to 12 show embodiments of high current loops 1 which function as magnetic field concentrators for shaping metal parts by a strong magnetic impulse and are designed with an opening 2 which is a portion of a mold for the part to be shaped and a radial slit 3 from the opening 2.

The magnetic field concentrator 1 has a second opening 4 with a larger clear diameter than the first opening 2 which has a clear diameter 5 on a common intersection so that the outline of the larger opening 4 sets at this intersection as shown in FIGS. 1, 9, 11 and 12.

The larger, second opening 4 is filled with a removable sabot/magnetic field shaping piece 6 fabricated from a metal with high electric conductivity, like aluminum, copper, silver or their alloys, which functions as a flux conductor.

The sabot/magnetic field shaping piece 6, particularly as shown in FIGS. 1, 6, 7, 9 and 11, include a section 7 which, with the first opening 2 completes a mold opening corresponding to the outline the part to be shaped 8.

The sabot/magnetic field shaping piece 6 is electrically insulated from the high current loop 1 and from the part to be shaped 8 by a thin layer 9, for instance a foil or a lacquer layer.

In addition, the part to be shaped 8 is insulated from the high current loop 1 and the sabot/magnetic field shaping piece 6 by a similar thin electrical insulation layer 9.

The thin layer 9 can be either on the inside of the larger opening 4 or alternately on the sabot/magnetic field shaping piece 6 and additionally placed on the part to be shaped 8.

In the preferred embodiment illustrated in FIGS. 1 to 6, the first opening 2, with the smaller diameter, connects with the radial slit 3 of the high current loop 1 and the larger, second opening 4 is positioned over the slit 3 and parallel to the smaller opening 2. The sabot/magnetic field shaping piece 6 must be pulled out to insert the parts to be shaped 8 in the opening 2, as shown by the dotted lines in FIG. 1, first of all from the larger opening 4 and then lifted or rotated to the side. After the part 8 is shaped, the process is reversed.

Figure 7:
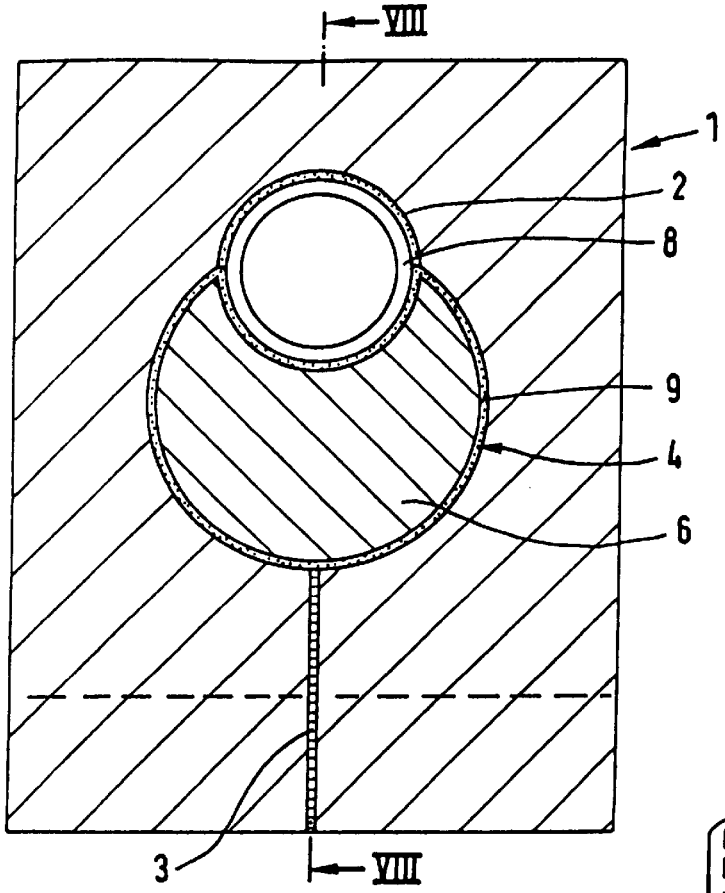
FIG. 7 is an opposite version of the magnetic field concentrator of FIGS. 1 to 6, modified so the larger opening with the sabot/magnetic field shaping piece is underneath the forming opening for the part to be shaped.
Figure 8:
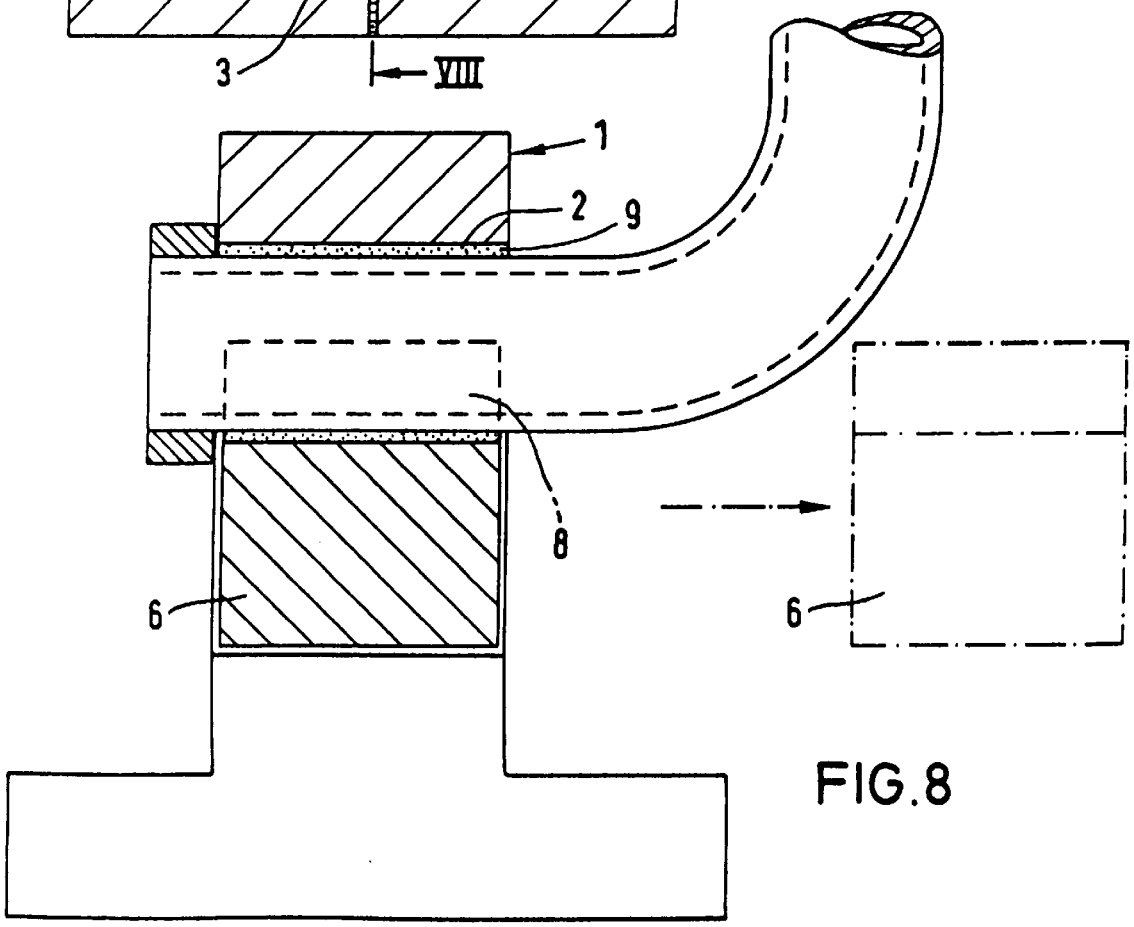
FIG. 8 is a vertical section through the magnetic field concentrator taken along the line VIII—VIII of FIG. 7.

In an alternate embodiment according to FIGS. 7 and 8, the second opening 4 connects with the radial slit 3 of the high current loop 1 and is arranged parallel to but under the first opening with the smaller diameter 2 which in this embodiment does not connect with the slit 3. The advantage of this embodiment is that the sabot/magnetic field shaping piece 6 may be pulled out from underneath the smaller opening 2 to insert a tubular part with a larger fitting into the larger opening 4 without hindering the insertion of the tube part. With this embodiment the sabot/magnetic field shaping piece 6 does not have to be swung to the side.

Figure 6:
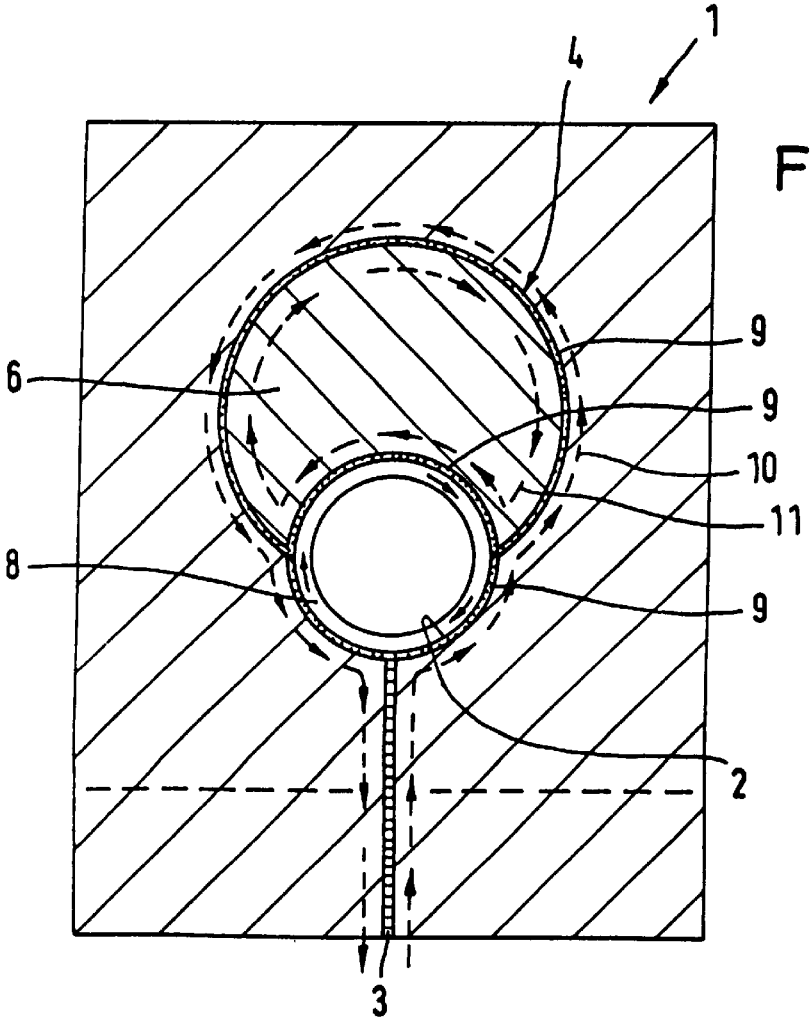
FIG. 6 is an enlarged vertical section taken through the magnetic field concentrator along the line VI—VI of FIG. 4.
Figure 12:
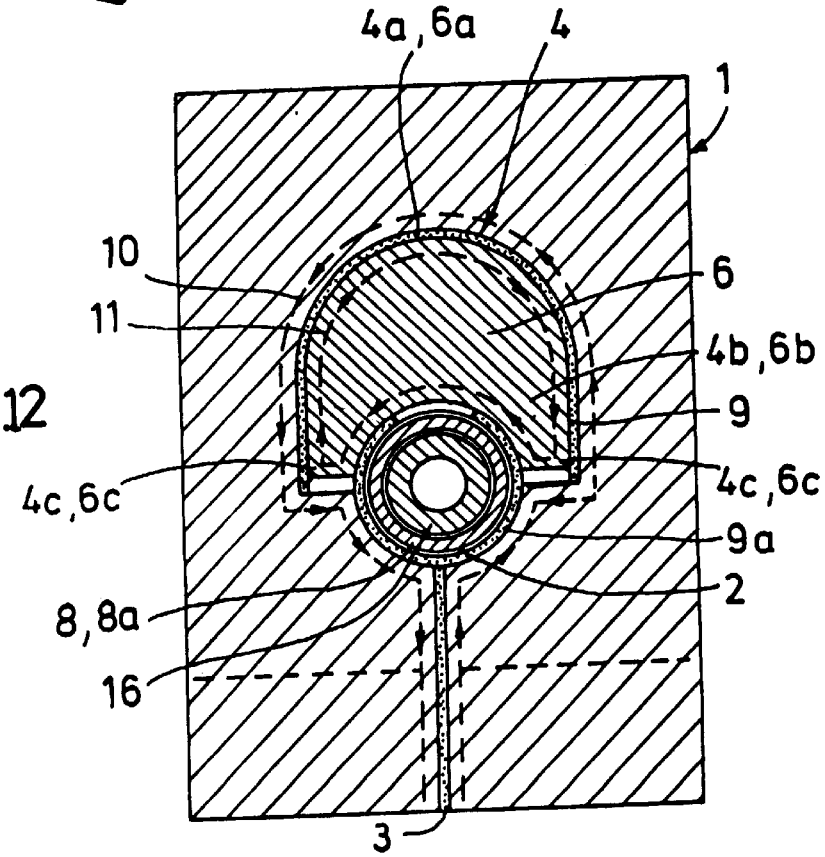
FIG. 12 is a vertical cutaway view through the magnetic field concentrator and the sabot/magnetic field shaping piece arranged to shape metal parts with a part to be shaped in the opening between the magnetic field concentrator and sabot/magnetic field shaping piece.

The direction of the current flow through the magnetic field concentrator 1 and the sabot/magnetic field shaping piece 6 during the shaping process is shown in FIGS. 6 and 12 by lines 10 and 11.

Figure 9:
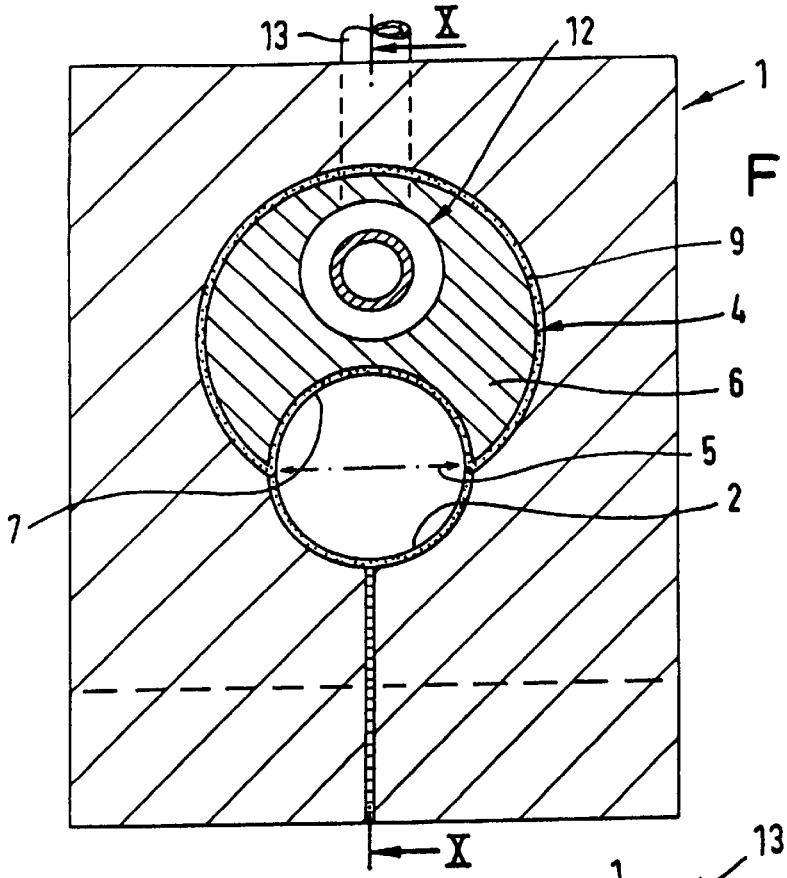
FIG. 9 is a still further modified version of the magnetic field concentrator with a cooling device in the sabot/magnetic field shaping piece.
Figure 10:
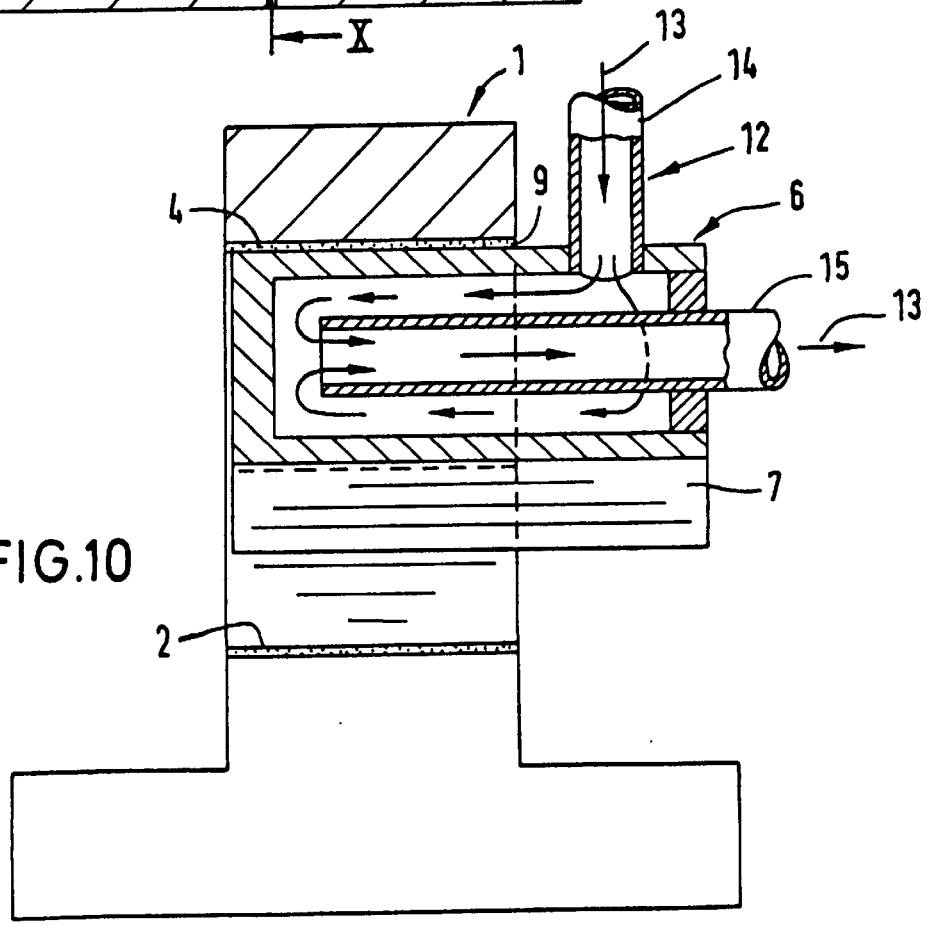
FIG. 10 is a vertical section through the magnetic field concentrator with the cooling system taken along the line X—X of FIG. 9.

As shown in FIGS. 9 and 10, the larger, second opening 4 can use a sabot/magnetic field shaping piece 6 provided with a heat exchanger manifold 12 for the continuous supply of a liquid or gaseous coolant 13.

This arrangement 12 for the coolant supply channels the coolant 13 between an input 14 and an outlet 15 through a double walled cooling system or other design suited for the application.

In all illustrated embodiments, the high current loop 1 is formed as a rectangular or square block and can therefor meet very high mechanical demands. It is flawless as suited for a clamping apparatus which will resist outside pressure and prevent expansion during the shaping process due to strong magnet powers.

Figure 11:
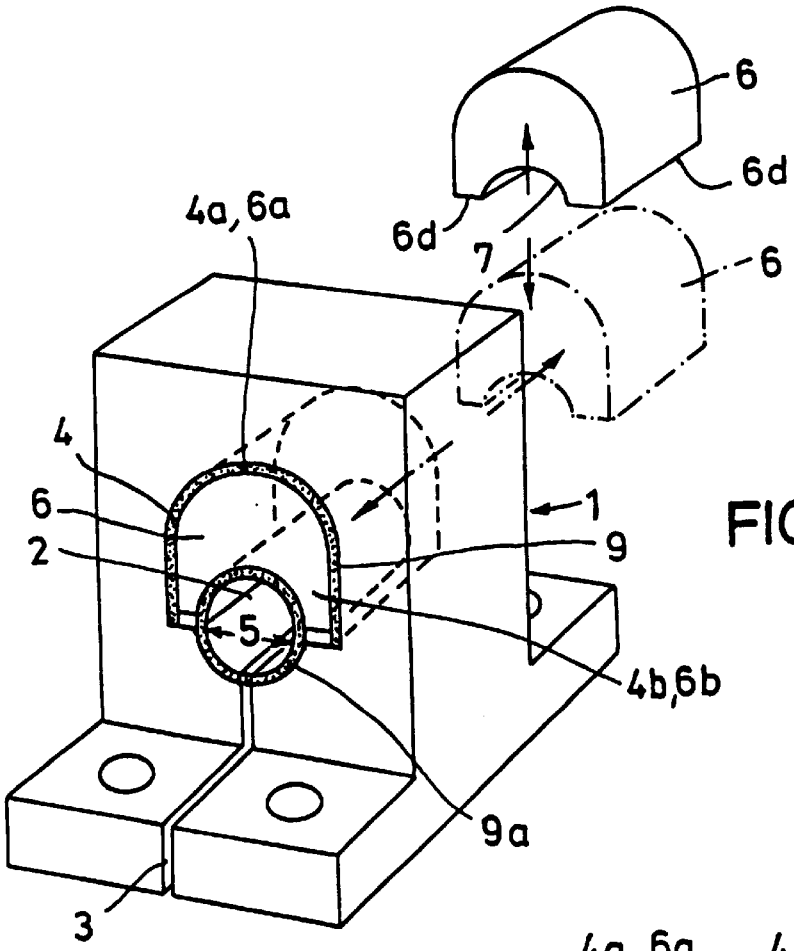
FIG. 11 is a perspective view illustrating the parallel axes of a magnetic field concentrator, a part to be shaped opening and a sabot/magnetic field shaping piece exploded from the second, larger receiving opening.

In FIGS. 11 and 12 the sabot/magnetic field shaping piece 6 is electrically insulated from the magnetic field concentrator 1 and from the part to be shaped 8 by a thin layer 9 of, for instance, a foil or a lacquer layer. Likewise the part to be shaped 8 is insulated from the magnetic field concentrator 1 and the sabot/magnetic field shaping piece 6 by a similar thin insulating layer 9*a*.

The insulating layers 9 and 9*a* can be either on the inside of the larger, second opening 4 or on the sabot/magnetic field shaping piece 6 and additionally on the part to be shaped 8.

The first opening 2, with the smaller cross-section, is bifurcated by the radial slit 3 in the magnetic field concentrator 1 and the larger, second opening 4 is positioned over the slit 3 with the axis of the upper section parallel to the axis of the smaller opening 2. The second, larger opening 4 and the sabot/magnetic field shaping piece 6 have an unround or angular cross-section. The larger, second opening 4 and the sabot/magnetic field shaping piece 6 have axes parallel to the axis of the first opening 2 which is opposite the cylindrical upper end curves 4*a* and 6*a* which are connected, as seen in the cross-sectional view, to essentially square base sections 4*b* and 6*b* by parallel outer surfaces 4*c* and 6*c* on both sides the first, smaller opening 2. The sabot/magnetic field shaping piece 6 has a rectangular lower longitudinal edge 6*d*.

It is especially beneficial if the insulating layer 9 between the sabot/magnetic field shaping piece 6 and the magnetic field concentrator 1 is made from a springy plastic strip so that if it is a few millimeters longer than the outer surface 6*c* of the sabot/magnetic field shaping pieces 6 it can also cover the lower edge sides of the opening 4. This facilitates the essential alignment of the sabot/magnetic field shaping piece 6 in the opening 4.

In FIGS. 11 and 12 the sabot/magnetic field shaping piece 6 can be supported by the part to be shaped in the opening 2 by the surrounding insulating layer 9*a* if the layer is a formed stiffener insulating ring. If it is, as shown in FIG. 12, it may be slit so that it may be sprung to allow problem-free removal of tubular parts 8*a* with fittings at both ends of the section.

To install the part to be shaped 8 in the opening 2, the sabot/magnetic field shaping piece 6 must be removed from the larger opening 4 as illustrated by the dashed lines in FIG. 11 by first axially pulling it out and then lifting or swinging it out. After the part to be shaped 8 is installed, the process is preformed in reverse sequence.

The direction of the current flow through the magnetic field concentrator 1 and the sabot/magnetic field shaping piece 6 during the shaping process is shown in FIGS. 6 and 12 by lines 10 and 11. The magnetic field concentrator 1 is formed as a rectangular or square block and can therefor meet very high mechanical demands. It is flawless as suited for a clamping apparatus which will resist outside pressure and prevent expansion during the shaping process due to strong magnet powers.

Shaping tubular metal parts 8*a* or shrinking tubular fittings or such 16 where the largest diameter exceeds the tubular diameter proceeds as follows:

First, the sabot/magnetic field shaping piece 6 is removed from the magnetic field concentrator 1 and moved to the side so that the larger opening 4 of the magnetic field concentrator is open.

Then the tube 8*a* with the fitting 16 to be placed there on is inserted into the larger opening 4 in the magnetic field concentrator and placed in the well of the smaller diameter opening 2.

Next the sabot/magnetic field shaping piece 6 is reinserted in the larger opening 4 of the magnetic field concentrator so that the tubular piece to be shaped 8*a* is enclosed.

Then the magnet impulse is triggered, so that the wall of the tubular piece 8*a* will be compressed into the recesses of the fitting 16.

Following this, the sabot/magnetic field shaping piece 6 is again removed from the magnetic field concentrator 1 so that the tubular piece 8*a* with the crimped fitting 16 lies free. The tubular piece 8*a* with the fitting is lifted and pulled out from the larger opening 4 in the magnetic field concentrator.

Resilient plastic stripes form an especially good insulation layer between the sabot/magnetic field shaping piece and the magnetic field concentrator which provides simple installation and removal operations of the sabot/magnetic field shaping piece in and out of the opening in the magnetic field concentrator.

The flat insulating plastic strips support the sabot/magnetic field shaping piece in the opening over the upper structure, on the sides and on the lower support. So a design can be achieved providing simple alignment for the installation and the removal of the sabot/magnetic field shaping pieces.

In addition, the insulating layer can be used to surround the part to be shaped in the work opening. As an insulating ring, it functions as a form stiffener, reinforcing the opening in the sabot/magnetic field shaping piece. The insulating ring is slit to provide resiliency so that its removal from a tubular part will be problem-free.

Especially good results are achieved with this process if the magnetic field concentrator 1 is connected to an impulse-transformer with the primary windings subdivided into several groups as taught according to DE 44 23 992 so their primary currents on the secondary of the impulse-transformer produces only one current-impulse.

While preferred embodiments of this invention have been illustrated and described, variations and modifications may be apparent to those skilled in the art. Therefore, we do not wish to be limited thereto and ask that the scope and breadth of this invention be determined from the claims which follow rather than the above description.

What is claimed is:

1. A magnetic field concentrator for shaping metal parts by magnetic impulse forming said magnetic field concentrator comprising:

an opening comprising a first section, and a larger second section, said first and second sections disposed parallel to each other and having end portions thereof disposed in a common plane, said first section sized to receive a part to be shaped by said magnetic field concentrator and corresponding to the outline of the part to be shaped, and said second section having a non-circular cross-section and having a concavity with a contour which matches the outer surface of the object to be shaped;

a flux conductor in the form of a removable sabot/magnetic field shaping piece fabricated from a metal with a high electrical conductivity and having a non-circular cross-section and a concavity with a contour which matches the outer surface of the object to be shaped, such that the flux conductor fills the volume of said second section of said opening said second section and said flux conductor including flat, abutting segments;

a conduit through said sabot/magnetic field shaping piece which supplies a heat exchange medium to the flux conductor; and insulating means for electrically insulating said sabot/magnetic field shaping piece from said magnetic field concentrator and from the part to be shaped.

2. A magnetic field concentrator as defined by claim 1, wherein said sabot/magnetic field shaping piece has a rectangular lower longitudinal edge.

3. A magnetic field concentrator as defined by claim 1, wherein, said magnetic field concentrator is fabricated from a material selected from the group including: aluminum, copper, silver and alloys there of.

4. A magnetic field concentrator as defined by claim 1, wherein, said sabot/magnetic field shaping piece is fabricated from a material selected from the group including: aluminum, copper, silver and alloys there of.

5. A magnetic field concentrator as defined by claim 1, wherein, said insulating means between said sabot/magnetic field shaping piece and said magnetic field concentrator is fabricated from a resilient plastic strip.

6. A magnetic field concentrator as defined by claim 5, wherein, said insulating means covers the outer surface of said sabot/magnetic field shaping piece facing said second section.

7. A magnetic field concentrator as defined by claim 5, wherein, said insulating means covers the surface of said second section facing said sabot/magnetic field shaping piece.

8. A magnetic field concentrator as defined by claim 5, wherein, said insulating means surrounding the part to be shaped is designed as a formed insulating ring.

9. A magnetic field concentrator as defined by claim 8, wherein, said insulating ring is slit and resilient.

10. A magnetic field concentrator as defined by claim 1, wherein, the cross-section of the part to be shaped is unround.

11. A magnetic field concentrator as defined by claim 1, Amended wherein, said second section and said sabot/magnetic field shaping piece have axes parallel to the axis of said opening and include cylindrical upper end curves opposite said opening, and square base sections connected to said cylindrical upper end curves by parallel outer surfaces located on both sides of said opening.

12. A magnetic field concentrator as defined by claim 11, wherein said sabot/magnetic field shaping piece has a rectangular lower edge.

13. A magnetic field concentrator as defined by claim 12, wherein, said magnetic field concentrator is fabricated from a material selected from the group including: aluminum, copper, silver and alloys there of with known additives to increase their hardness.

14. A magnetic field concentrator as defined by claim 13, wherein, said sabot/magnetic field shaping piece is fabricated from a material selected from the group including: aluminum, copper, silver and alloys there of with known additives to increase their hardness.

15. A magnetic field concentrator as defined by claim 14, wherein, said insulating means between said sabot/magnetic field shaping piece and said magnetic field concentrator is fabricated from a resilient plastic strip.

16. A magnetic field concentrator as defined by claim 15, wherein, said insulating means covers the outer surface of said sabot/magnetic field shaping piece facing said second section.

17. A magnetic field concentrator as defined by claim 15, wherein, said insulating means covers the surface of said second section facing said sabot/magnetic field shaping piece.

18. A magnetic field concentrator as defined by claim 15, wherein, said insulating means surrounding the part to be shaped is designed as a form stiffener insulating ring.

19. A magnetic field concentrator as defined by claim 18, wherein, said insulating ring is slit and resilient.

20. A magnetic field concentrator as defined by claim 19, wherein, the cross-section of the part to be shaped is selected from the group of geometrical shapes including: square, rectangular and oval.

* * * * *

UNITED STATES PATENT AND TRADEMARK OFFICE

CERTIFICATE OF CORRECTION

PATENT NO : 5,953,805

DATED : September 21, 1999

INVENTOR(S) : Erich Steingroever

It is certified that error appears in the above-identified patent and that said Letters Patent are hereby corrected as shown below:

Claim 11 should read as follows:

Claim 11: A magnetic field concentrator as defined by claim 1, wherein, said second section and said sabot/magnetic field shaping piece have axes parallel to the axis of said opening and include cylindrical upper end curves opposite said opening, and square base sections connected to said cylindrical upper end curves by parallel outer surfaces located on boths sides of said opening.

Signed and Sealed this

Eleventh Day of April, 2000

*Attest:*

*Attesting Officer*

Q. TODD DICKINSON

*Director of Patents and Trademarks*